US007299534B2

(12) United States Patent
Rauscher

(10) Patent No.: US 7,299,534 B2
(45) Date of Patent: Nov. 27, 2007

(54) METHOD OF FABRICATION OF LOW-LOSS FILTER AND FREQUENCY MULTIPLEXER

(75) Inventor: Christen Rauscher, Alexandria, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 11/355,895

(22) Filed: Feb. 17, 2006

(65) Prior Publication Data

US 2006/0185161 A1 Aug. 24, 2006

Related U.S. Application Data

(60) Provisional application No. 60/656,548, filed on Feb. 18, 2005.

(51) Int. Cl.
*H01P 5/12* (2006.01)
*H01P 1/20* (2006.01)

(52) U.S. Cl. ..... 29/600; 333/135; 333/210; 333/209

(58) Field of Classification Search ..... 333/210, 333/135, 208, 209, 211, 212
See application file for complete search history.

(56) References Cited

U.S. PATENT DOCUMENTS 3,157,847 A * 11/1964 Williams ..... 333/239
3,845,422 A * 10/1974 Rhodes ..... 333/208
3,949,327 A * 4/1976 Chapell ..... 333/210
4,614,920 A * 9/1986 Tong ..... 333/135
4,673,903 A * 6/1987 Saad ..... 333/210
4,675,631 A * 6/1987 Waggett ..... 333/210
5,382,931 A 1/1995 Piloto et al.
6,118,978 A * 9/2000 Ihmels ..... 455/12.1
6,201,949 B1 * 3/2001 Kich et al. ..... 455/12.1
6,535,083 B1 * 3/2003 Hageman et al. ..... 333/210
6,547,982 B1 * 4/2003 Shepherd et al. ..... 252/62.3 Q
2005/0156689 A1 7/2005 Hageman et al.

OTHER PUBLICATIONS

Saad et al., "Evanescent Mode-Serrated Ridge Waveguide Bandpass Harmonic Filters", 16th European Microwave Conference Proceedings, pp. 287-291, Sep. 1986.

(Continued)

*Primary Examiner*—Benny Lee
*Assistant Examiner*—Kimberly E Glenn
(74) *Attorney, Agent, or Firm*—John J. Karasek; L. George Lagg

(57) ABSTRACT

A method of fabricating a waveguide filter includes forming a monolithic polymeric dielectric core configured for fabricating a dielectric-filled cavity, where the core includes a plurality of spaced-apart depressions; applying a layer of conducting metal to an outer surface of the core to form a metallized core with a conductive metal layer, wherein the metal layer includes port openings at opposite ends of the metallized core, and wherein metallized depressions thereby formed are the ridges of the filter's ridge-waveguide sections; and mounting the metallized core on a supporting carrier. A desired number of such filters can be connected with an electrical-series-type connection among one port of each filter to form a frequency multiplexer having a waveguide manifold.

10 Claims, 10 Drawing Sheets

OTHER PUBLICATIONS

Bomemann et al., "Transverse Resonance, Standing Wave, and Resonator Formulations of the Ridge Waveguide Elgenvalue Problem and Its Application to the Design of E-Plane Finned Waveguide Filters", IEEE Trans. on Microwave Theory and Techniques, vol. 8, No. 8, pp. 1104-1113, Aug. 1990.

Rong et al., "Low-Temperature Cofired Ceramic (LTCC) Ridge Waveguide Bandpass Chip Filters", IEEE Trans. on Microwave Theory and Techniques, vol. 47, No. 12, pp. 2317-2324 Dec. 1999.

Rong et al., "Low Temperature Cofired Ceramic (LTCC) Ridge Waveguide Multiplexers", IEEE MTT-S Digest. pp. 1169-1172 (2000).

Emerson & Cuming Product Bulletin Rev. Aug. 16, 2004 "Eccostock® CK".

* cited by examiner

METHOD OF FABRICATION OF LOW-LOSS FILTER AND FREQUENCY MULTIPLEXER

CROSS REFERENCE TO RELATED APPLICATIONS

The present application claims the benefit of the priority filing date of provisional patent application Ser. No. 60/656,548, filed Feb. 18, 2005, incorporated herein by reference. The present application is related to patent application U.S. Ser. No. 11/355,894, entitled LOW-LOSS FILTER AND FREQUENCY MULTIPLEXER, filed concurrently herewith.

FIELD OF THE INVENTION

This invention relates in general to a method of fabricating waveguide filters. More particularly, the invention relates to a method of fabricating compact low-loss ridge-waveguide filter, and filters of this type with different passbands for use in frequency multiplexing.

BACKGROUND OF THE INVENTION

The incorporation of ever-higher degrees of functionality into electronic systems, while making maximum use of available bandwidth in dense spectral environments, places stringent demands on filters that are tasked with the preservation of wanted signals and the suppression of unwanted ones. Filters and banks of filters in the form of so-called frequency multiplexers assume critical roles in many electronic systems, tasked with the suppression of unwanted signals that threaten to compromise system performance, while preserving wanted signals. The perennial challenge is to reduce unit size and production cost without undue sacrifice of filter performance. In addition to frequency selectivity, a filter's passband insertion loss normally constitutes one of the primary design concerns, be it to minimize noise in receiver front ends or signal attenuation in exciter applications. In the latter, thermal constraints may add to the design challenge.

Among the most compact and cost-effective filter solutions available are ones that rely on planar circuit topologies that employ constant-thickness layers of dielectric materials in conjunction with thin strip conductors for guiding propagating waves, exemplified by familiar implementation formats such as microstrip, stripline, and some versions of low-temperature cofired ceramic (LTCC). Among the principal drawbacks of these formats is elevated passband insertion loss that results from high current densities at the conductive strips' thin edges. Under resonant conditions, as encountered especially in bandpass filters, this invariably leads to high signal attenuation at passband frequencies and compromised frequency selectivity. A further concern may arise when dielectric layers of relatively poor thermal conductivity impede the extraction of loss-induced heat from the strip conductors, with power handling limited by heat-generated mechanical stresses. Similar concerns also apply, albeit to a lesser extent, to popular coaxial-type structures and other filter realizations that conceptually rely on two-conductor-based wave propagation with predominantly transverse electromagnetic fields.

In contrast, three-dimensional (3D) filter structures that are composed of coupled, metal-clad, dielectric-filled, single-conductor waveguide cavities, whose wave-guiding peripheries constitute single conducting envelopes, can distribute currents within the inner surfaces of these envelopes more optimally. This permits high current densities to be avoided, resulting in best-possible transmission-loss characteristics and frequency selectivity for a given aggregate filter volume. Furthermore, with electrical currents conducted exclusively in peripheral waveguide surfaces that are externally accessible and from which heat generated through dissipation can be easily extracted, these types of filters can handle very high levels of incident power. This results in filters with not only superior electrical performance, but also with excellent thermal performance for a given size.

Among the drawbacks of conventional 3D-waveguide filters are bandwidth limitations imposed by the practical need to operate in a regime where electromagnetic waves propagate only in a single mode. The limitations result from the absence of wave propagation below a geometry-determined cutoff frequency and the emergence of higher-order wave-propagation modes above a geometry-determined upper frequency limit. As an example, for common rectangular waveguide, the upper frequency bound is generally twice the low-end cutoff frequency, which imposes unacceptable constraints in cases where filters must cover multiple octaves. Furthermore, per-unit fabrication costs of 3D waveguide filters are generally higher than for contending planar-circuit counterparts.

The use of ridge waveguide is particularly attractive, as this allows considerably broader frequency coverage than conventional rectangular waveguide, relaxing bandwidth constraints while still retaining most of the advantages of 3D waveguides. Ridge-waveguide structures utilize capacitive loading in the cross-sectional centers of the guides to lower respective cutoff frequencies, while essentially not affecting upper frequency bounds, thereby increasing available percentage bandwidth, often by a substantial amount. As for the positioning of the lower and upper band limits on an absolute frequency scale, assuming application-predetermined maximum cross-sectional dimensions of the waveguide, this can be achieved by filling the internal regions of pertinent waveguide sections with a dielectric material of a suitable relative dielectric constant, whereby frequencies bounds simply scale proportional to the square root of the effective dielectric constant. Over the past twenty years, research has concentrated on exploiting the advantages of ridge waveguide and derivatives thereof for use in filters and frequency multiplexers that must cover wide frequency range. Current needs pertain, in particular, to the miniaturization of such devices.

BRIEF SUMMARY OF THE INVENTION

According to the invention, a method of fabricating a waveguide filter includes forming a monolithic polymeric dielectric core configured for fabricating a dielectric-filled cavity, where the core includes a plurality of spaced-apart depressions; applying a layer of conducting metal to an outer surface of the core to form a metallized core with a conductive metal layer, wherein the metal layer includes port openings at opposite ends of the metallized core, and wherein metallized depressions thereby formed are the ridges of the filter's ridge-waveguide sections; and mounting the metallized core on a supporting carrier.

Also according to the invention is a method of fabricating a frequency multiplexer utilizing a selected number of such filters by connecting the filters using an electrical-series-type connection among one port of each filter to form a frequency multiplexer having a waveguide manifold.

The invention is preferably realized as a monolithic core structure, made of appropriate dielectric material or composites of dielectric materials, with the structure's outer surface selectively metallized to form the needed electrically conductive waveguide envelope. The latter doubles as a convenient heat sink, as all electrically conducting filter surfaces where heat is generated through electrical conduction losses are externally accessible.

The filters of the invention exhibit low passband insertion loss, wide upper stopbands, and small physical dimensions, and the accommodation of high incident power levels. The filters can be easily designed using commercial, general-purpose design software, and produced using conventional fabrication techniques. Injection molding techniques employing plastics-based, low-loss dielectric materials present a particularly attractive option.

Advantages and features of the invention in its numerous embodiments include:

1) the realization of a waveguide filter as an externally metallized, monolithic dielectric core, comprising ridge waveguide and evanescent-mode segments;

2) the realization of the dielectric core as a composite of dielectric materials with differing dielectric constants;

3) the realization of evanescent-mode-waveguide inter-resonator coupling segments with widths of these segments narrower than the width of the main, preferably ridge-type waveguide, so as to raise the cutoff frequencies in the evanescent-mode regions;

4) the use of additional, preferably series connected, reactive circuit elements to augment the impedance-transforming port matching networks that connect the end ridges of a filter to its external ports;

5) the electrical series connection of filters to a frequency-multiplexer manifold;

6) the realization of a frequency-multiplexer manifold as a cascade connection of electrically short waveguide segments and quasi-lumped waveguide circuit components, such as irises;

7) the application of a heat sink to the (outside) metallization of filters and multiplexer manifold to enable operation at high incident power levels.

8) the application of cost-effective injection molding techniques to manufacture filter dielectric cores.

Additional features and advantages of the present invention will be set forth in, or be apparent from, the detailed description of preferred embodiments which follows.

DETAILED DESCRIPTION OF THE INVENTION

Figure 1:
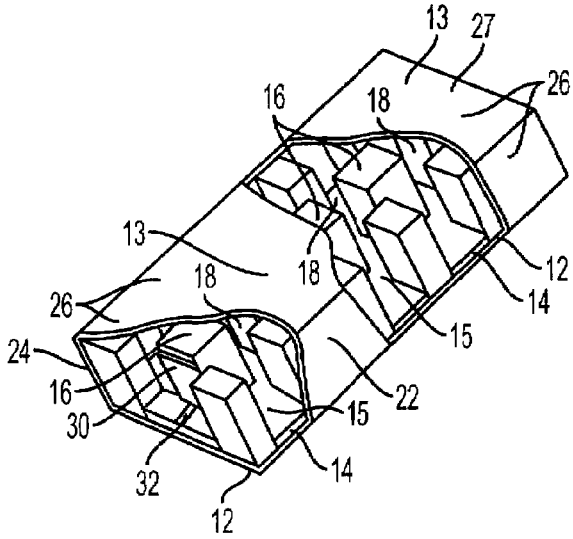
FIG. 1 is a perspective representation of a five-pole cavity bandpass filter with partially cut-away housing to illustrate detail of the capacitively coupled microstrip port launchers and resonated uniform sections of single-ridge waveguide with interspersed, uniformly constricted, evanescent-mode coupling regions according to the invention.

Referring now to FIG. 1. a bandpass filter 10 according to the invention includes a base 12 fabricated from a metal or suitable conductor material, as is further discussed below. Dielectric layers 14 and 15 are positioned on base 12 and are fabricated from a moldable plastic, as is also further described below. A plurality of waveguide ridges 16 are positioned on layer 14 and embedded in layer 15 along the filter's longitudinal axis as shown. A plurality of evanescent-mode coupling regions 18 are defined by and are between adjacent ridge waveguides with waveguide ridges 16. Pairs of metal constrictors 20 flank adjacent evanescent-mode coupling regions along the respective filter sides 22 and 24. A conductive housing 26 that includes a common roof 13, and also incorporates base 12, as well as sides 22 and 24, serves as the enclosure for filter 10. An outer surface 27 of housing 26 is selectively metallized to form the needed electrically conductive waveguide envelope, and doubles as a convenient heat sink. Also indicated is a series capacitor 30 and a microstrip feeder line 32 used for impedance-matching at each of the filter's two ports. The operating principles and characteristics, structural and design details, fabrication methods, and experimental and theoretical designs of filter 10 are as follows.

Resonant Cavities

In a bandpass situation, cutoff frequencies of ridge waveguide segments used in the realization of resonant filter cavities should be placed below the filter's lower passband edge, preferably allowing a margin of ten to twenty percent to avoid excess losses encountered when operating close to cutoff. Although not a prerequisite, it is assumed for analytical convenience that each ridge waveguide segment maintains a uniform cross section along its entire length, with allowance for differences in cross-sectional dimensions among individual waveguide segments. The upper bound on single-mode wave propagation within each resonated ridge waveguide section should be positioned well above the filter's upper passband edge, preferably even above the highest stopband frequency of interest. The ratio of upper to lower frequency bound on single-mode operation determines the amount of transverse capacitive loading the ridge must provide, realized through suitable choices for ridge width and ridge gap spacing. It is assumed that maximum allowable filter cross-sectional dimensions are utilized for best-possible loss performance, and that the effective dielectric constant of the waveguide fill material is chosen to position relevant characteristic frequencies as suggested.

In broadband cases, substantial capacitive loading is required, calling for wide ridges or tightly spaced gaps or both. Increasing ridge width raises the cutoff frequency of the waveguide, approaching in the limit that of a conventional rectangular waveguide of same overall width. This sets a practical upper bound on ridge width. Values in the vicinity of 20 percent of a waveguide's total broadside dimension have been found empirically to provide a good compromise in many practical situations. As for gap spacing, this becomes largely a fabrication issue, as manufacturing tolerances place a lower bound on reproducible values.

A third adjustable parameter is the length of a resonator's ridge waveguide section, measured in the direction of fundamental-mode wave propagation. If the overall length of the composite filter is not a dominant concern, ridge lengths may be increased to further boost capacitive loading of the guide. This reinforces the distributed-element character of the structure, however, causing a decrease in upper stopband width. In cases, where filter upper stopbands must extend beyond three times the center frequencies of their respective primary passbands, resonator single-ridge waveguide segments with roughly square-shaped footprints have been found to yield favorable results.

Another option to control a ridge waveguide's usable bandwidth is to replace the previously implied single-dielectric-constant waveguide fill material with a composite of materials of substantially differing dielectric properties. This offers, in return for some additional effort in fabrication, both increased design flexibility that can be exploited to optimize filter electrical performance, and an opportunity to reduce the sensitivity of a filter's response characteristics to manufacturing tolerances. Particularly attractive is the use of dielectric materials in constant-thickness layers, with high-dielectric-constant materials concentrated in the high-field gap regions of resonator ridges. This permits ridge-gap spacings to be suitably enlarged for easier fabrication. Dielectric constants in the remaining regions are free design variables that can be employed to control other filter performance attributes.

Inter-Resonator Coupling

Coupling among ridge waveguide resonators could, in principle, be either capacitive or inductive or possibly even both. Inductive coupling is particularly straightforward to implement through the use of evanescent-mode waveguide sections, as illustrated in FIG. 1. A coupling section of this type can be represented by a series-connected inductive circuit element and two flanking, shunt-connected inductive elements.

To avoid undesired shifts in primary cavity resonance frequencies due to these inductances, the lengths of adjacent resonator ridge waveguide segments are preferably reduced, with parasitic resonances and associated secondary filter passbands shifted to higher frequencies as a useful byproduct. For analytical expedience, a uniform rectangular waveguide cross section is individually assumed for each evanescent-mode coupling section, although this again does not represent a necessary condition.

Among the main factors determining the values of the coupling inductances, and with them the degree of inter-resonator coupling, are the height of the evanescent-mode waveguide, the width of the guide, and the coupling length. The width of the waveguide determines its cutoff frequency, which should generally be positioned comfortably above a filter's upper passband edge. Depending on associated stopband requirements, constrictions like those indicated in FIG. 1 may not be needed. Both the waveguide's width and its length determine the degree of coupling between adjacent resonators. Broad filter bandwidths require tightly coupled resonators, which in turn call for short coupling sections that may be difficult to implement reproducibly. As concluded from design exercises based on the previously cited broadband filter case, practical situations should rarely require evanescent-mode coupling sections to be narrower than one half the broadside dimension of adjacent ridge waveguide sections, while still yielding realizable evanescent-mode waveguide lengths of at least one half of a typical ridge width.

The degree of inter-resonator coupling also depends, of course, on the properties of the dielectric materials used to fill the evanescent-mode waveguide. In broadband cases, it is beneficial to employ materials with lowest-possible relative dielectric constants. Such a solution is illustrated in FIG. 1, where evanescent-mode coupling sections are predominantly filled with material of lower dielectric constant, compared to the fill material in the high-field gap regions of the resonated ridge waveguide sections. The average dielectric constant for the evanescent-mode sections could be further reduced by locally replacing the indicated continuous layer of higher-dielectric-constant material with lower-dielectric-constant material.

Port Matching Networks

To connect among high-frequency components, coaxial or strip-type filter input and output port interfaces 28 referenced to 50 ohms can be implemented with the help of conventional impedance-matching networks (described below) that transition between single-ridge waveguide and microstrip or stripline 30, as indicated in FIG. 1. The networks are tasked both with shifting pertinent impedance levels and with providing compensation for intrinsic parasitic reactances. This can be achieved with relatively low-complexity networks that may be implemented in microstrip or stripline form. The losses inherent in such uses of strip-type circuits are seldom a concern, as these circuits tend not to be highly resonant.

DESIGN METHOD

General Procedure

After employing conventional synthesis techniques to scope out a prospective filter design with regard to the number of coupled resonators needed to meet a given set of specifications, the design process requires a rough estimation of anticipated ranges for the internal geometric dimensions of the filter's ridge and evanescent-mode waveguide sections that constitute its basic building blocks. Electromagnetic field analyses are then performed that bracket the multi-dimensional variable space. For each variable, the analysis of two limiting cases will generally provide sufficient information. Calculations should be performed with a three-dimensional electromagnetic field simulator. In principle, any one of several available general-purpose software packages can be used. Results shown below are obtained using commercial software based on the time-domain finite-difference approach.

From the results of the electromagnetic field simulations, parameterized equivalent-circuit models are derived for generic building-block sections of ridge and evanescent-mode waveguide, and for the filter's input and output transitions. In each case, a multi-port network is defined, with one pair of ports for every combination of designated filter design variables previously subjected to electromagnetic field simulation. Pertinent equivalent-circuit models are connected between corresponding ports, whereby all such models are of identical topology. Circuit-component values within each representation are expressed as functions of designated independent filter design variables, and as functions of structural parameters that are to remain invariant during the design of the actual filter and are hence also kept constant among all model representations within a given multi-port network. By simultaneously curve-fitting the responses of the equivalent-circuit representations to the respective, previously calculated electromagnetic field simulation results, a consistent set of parameter values is obtained. Any commercial linear-circuit optimization software can be used for this purpose, with a preference for ones that can accommodate code modules written in Visual Basic or C++. From the building-block models thus obtained, an equivalent-circuit for the entire filter can be assembled, wherein designated building-block design variables collectively become the independent variables of the composite filter to be subjected to numerical optimization.

Upon completion of the optimization process, electromagnetic field analysis can be employed to verify the accuracy of the model-based filter response. The agreement, in general, is very good. Residual discrepancies can be resolved in a simple, iterative fashion by expressing them in terms of a least-square error function and reoptimizing the composite filter's equivalent circuit to yield a best fit of its characteristics to the results obtained with the electromagnetic field simulator. Changes in parameter values are subsequently subtracted from the initially obtained values, and the electromagnetic field simulator is reengaged to calculate an updated filter response for the modified set of parameters. Based on a series of performed mock design exercises, no more than three such iterations should generally be necessary.

Ridge Waveguide

Figure 2:
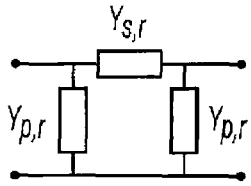
FIG. 2 is an equivalent circuit of a ridge waveguide segment according to the invention.

The equivalent-circuit of a segment of ridge waveguide is similar to that of conventional hollow waveguide. Using standard nomenclature for a single-ridge waveguide segment of total width $a_{g,r}$, total height $b_{g,r}$, ridge width $w_{g,r}$, ridge gap spacing $s_{g,r}$, and waveguide length $l_{g,r}$, the admittance values of the segment's equivalent-circuit elements in the two-port representation of FIG. 2 can be expressed as $$Y_{p,r} = -\frac{j}{Z_{g,r}}\tanh\left(\frac{\gamma_{g,r}l_{g,r}}{2}\right) \tag{1}$$

$$Y_{s,r} = -\frac{j}{Z_{g,r}}\cdot\frac{1}{\sinh(\gamma_{g,r}l_{g,r})} \tag{2}$$

with the waveguide's characteristic impedance, $Z_{g,r}$ and propagation factor, $\gamma_{g,r}$, given by $$Z_{g,r} = \frac{\bar{Z}_{g,r}}{\sqrt{\left(\frac{f_{c,r}}{f}\right)^2 - 1}}\left(1 + \bar{g}_{z,r}\frac{s_{g,r} - \bar{s}_{g,r}}{\bar{s}_{g,r}}\right) \tag{3}$$

$$\gamma_{g,r} = \frac{2\pi f\sqrt{\bar{\varepsilon}_{r,r}}}{c}\sqrt{\left(\frac{f_{c,r}}{f}\right)^2 - 1} \tag{4}$$

In these equations, f denotes the frequency variable, c the speed of light, and $\bar{\epsilon}_{r,r}$ the effective relative dielectric constant of the waveguide's fill material, with the guide cutoff frequency represented by $$f_{c,r} = \bar{f}_{c,r}\left(1 + \bar{g}_{f,r}\frac{s_{g,r} - \bar{s}_{g,r}}{\bar{s}_{g,r}}\right) \tag{5}$$

Equations (3) and (5) are linearized functions, expanded around a conveniently selected reference value, $\bar{s}_{g,r}$, for the waveguide's ridge spacing. The spacing, $s_{g,r}$, together with the waveguide length, $l_{g,r}$, can serve as independent filter design variables. The expressions can naturally be extended to include additional independent design variables, such as the ridge width, $w_{g,r}$. It is often more efficient, however, to keep generality at a minimum and, instead, invest upfront in a small number of exploratory filter designs to empirically determine a practicable, fixed value for $w_{g,r}$, and possibly also for $s_{g,r}$. For good reproducibility and ease of fabrication, the ridge gap spacing, $s_{g,r}$, should be made as large as possible. With reference to comments made above, any chosen fixed value(s) should allow for sufficient capacitive loading in the center of the waveguide's cross section to position the waveguide cutoff frequency comfortably below the filter's lower passband edge, while simultaneously keeping corresponding values of ridge waveguide length, $l_{g,r}$, short enough to avoid corruption of the filter's upper stopband region with spurious responses.

Fitting port responses of the ridge waveguide equivalent circuit to corresponding responses obtained from three-dimensional electromagnetic field simulations, in accordance with the modeling procedure outlined above, yields values for the characteristic-impedance coefficients, $\bar{Z}_{g,r}$ and $\bar{g}_{z,r}$, the cutoff-frequency coefficients, $\bar{f}_{c,r}$, and $\bar{g}_{f,r}$, and the effective relative dielectric constant of the fill material, $\bar{\epsilon}_{r,r}$. These quantities, together with the reference values of designated independent design variables, are all marked with bars placed over their respective symbols to indicate that they are to remain invariant during subsequent applications of the equivalent-circuit model to an actual filter design. Also to be marked with bars are other design constants, which may include application-specified geometric dimensions and material properties, as well as quantities that are assigned fixed values for expediency. Each parameter, coefficient, and variable symbol is given two subscripted indices separated by a comma. The first index serves as a common descriptor. The second index points to a particular structural feature, using r for ridge waveguide, e for evanescent-mode waveguide,j for junction, and l for launcher.

Utilizing this nomenclature, fixed cross-sectional single-ridge waveguide dimensions of $\bar{a}_{g,r}$=30 mm, $\bar{b}_{g,r}$=12 mm, and $\bar{w}_{g,r}$=6 mm are chosen for illustration purposes. Both the ridge gap spacing, $s_{g,r}$ and the waveguide length, $l_{g,r}$, remain design variables, with a reference value $\bar{s}_{g,r}$=1.2 mm assigned to the former. The cross-sectional geometry is commensurate with the experimental 1-1.45-GHz bandpass filter described below. As in the experimental filter, the employed waveguide fill materials have respective relative dielectric constants of 6 and 15. Utilizing two simultaneously optimized cases with $s_{g,r}$=1.2 mm and $s_{g,r}$=2.4 mm, respectively, a consistent set of design-invariant model parameter values is derived, with $\bar{Z}_{g,r}$=12.69Ω $\bar{g}_{z,r}$=0.50, $\bar{f}_{c,r}$=0.49 GHz, $\bar{g}_{f,r}$=0.44, and $\bar{\epsilon}_{r,r}$=13.69.

Figure 3:
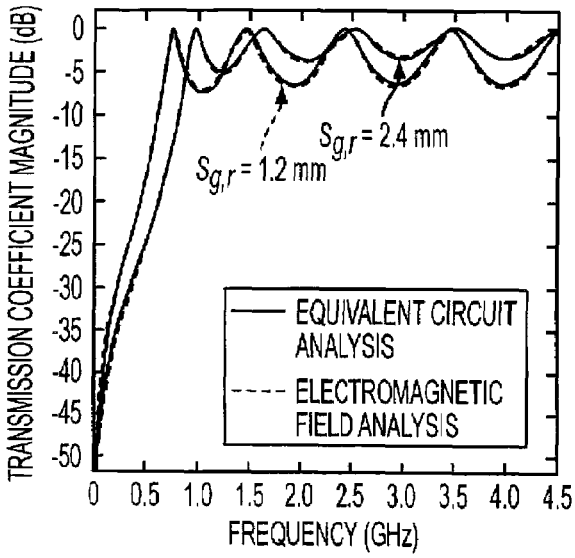
FIG. 3 is a graph showing transmission magnitude characteristics of a ridge waveguide segment for two different values of ridge gap spacing according to the invention.

To efficiently perform electromagnetic field calculations for frequencies below a ridge waveguide's cutoff frequency, the electromagnetic field simulator requires that external connections to the waveguide section's input and output ports sustain a propagating fundamental mode with mainly transverse electromagnetic fields. This is accommodated by adding, at each port, an adapter that consists of a strip conductor connected to the bottom edge of the respective ridge's end face. The strips used here are 12 mm long and have the same 6-mm width as the ridge. In the calculations, each port reference plane is positioned at the strip-to-ridge transition, allowing the latter to be represented in the equivalent circuit by a single shunt-connected reactance element in combination with an ideal transformer, analogous to the model for the transition from microstrip to ridge waveguide discussed below. The 50-Ω-normalized transmission-coefficient magnitude responses obtained in this fashion are compared in FIG. 3 to corresponding model predictions that likewise include the effects of the port adapters. The plotted curves are only intended to provide an indication of the model's accuracy. The equivalent-circuit elements associated with the port adapters are subsequently stripped away to yield a de-embedded core model of the ridge waveguide segment consistent with FIG. 2.

Inter-Resonator Coupling

Figure 4:
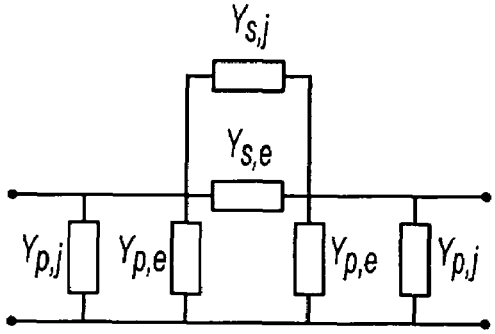
FIG. 4 is an equivalent circuit of an evanescent-mode coupling section with junction parasitics according to the invention

The equivalent circuit of an evanescent-mode waveguide section used to couple two adjacent ridge waveguide cavity resonators is shown in FIG. 4. It contains equivalent-circuit elements representing a segment of waveguide, supplemented by elements relating to junction parasitics. The formulation detailed in the following applies, thereby, equally to configurations that incorporate evanescent-mode-waveguide constrictions, as shown in FIG. 1, and those without constrictions. Assuming a rectangular, evanescent-mode waveguide of cross-sectional width, $a_{g,e}$, and height, $b_{g,e}$, the admittance values of the model elements that are specifically associated with longitudinal, evanescent-mode wave propagation, as functions of evanescent-mode waveguide coupling length, $l_{g,e}$, are $$Y_{p,e} = -\frac{j}{Z_{g,e}}\tanh\left(\frac{\gamma_{g,e}l_{g,e}}{2}\right) \tag{6}$$

$$Y_{s,e} = -\frac{j}{Z_{g,e}}\cdot\frac{\bar{r}_{m,e}}{\sinh(\gamma_{g,e}l_{g,e})} \tag{7}$$

where the waveguide's characteristic impedance, $Z_{g,e}$, and propagation factor, $\gamma_{g,e}$, can be obtained from $$Z_{g,e} = \frac{\bar{Z}_{g,e}}{\sqrt{\left(\frac{f_{c,e}}{f}\right)^2 - 1}}\cdot\frac{\bar{a}_{g,e}}{a_{g,e}} \tag{8}$$

$$\gamma_{g,e} = \frac{2\pi f\sqrt{\bar{\epsilon}_{r,e}}}{c}\sqrt{\left(\frac{f_{c,e}}{f}\right)^2 - 1} \tag{9}$$

with the waveguide's cutoff frequency given by $$f_{c,e} = \bar{f}_{c,e}\frac{\bar{a}_{g,e}}{a_{g,e}} \tag{10}$$

Model parameters $\bar{r}_{m,e}$, $\bar{Z}_{g,e}$, $\bar{f}_{c,e}$, and $\bar{\epsilon}_{r,e}$, represent design-invariant quantities. The principal independent design variables are the actual physical length of the evanescent-mode waveguide section, $l_{g,e}$, and the waveguide's physical width, $a_{g,e}$. For convenience, and without undue loss of design flexibility, the height of the evanescent-mode waveguide section is chosen to be equal to the total, uniform height of adjacent single-ridge waveguide segments, with $b_{g,e}=\bar{b}_{g,e}=b_{g,r}=\bar{b}_{g,r}$. The reference value, $\bar{a}_{g,e}$, of the evanescent-mode waveguide's width can be arbitrarily assigned, but is normally chosen to lie within a practical range of waveguide broadside dimensions.

As for the equivalent-circuit elements in FIG. 4 that relate to parasitic junction effects, the admittance value of each of the two parallel-connected elements is adequately described by a simple design-invariant capacitance, $\bar{C}_{p,j}$, according to $$Y_{p,j}=j2\pi f\bar{C}_{p,j} \tag{11}$$

The series-connected, junction-related model element in FIG. 4 comprises both a capacitive component that scales with the length of the evanescent-mode section, and a term representing a transmission-line stub with a short-circuit termination. The latter accounts for electromagnetic waves propagating in vertical direction between opposing ridge-end faces of adjacent single-ridge waveguide segments. The composite value of the series-connected admittance is approximated by the relationship $$Y_{s,j} = j2\pi f\bar{C}_{s,j}\frac{\bar{l}_{g,e}}{l_{g,e}} - \frac{j}{Z_{g,j}}\mathrm{ctan}(\beta_{g,j}\tilde{l}_{g,j}) \tag{12}$$

where $\bar{l}_{g,e}$ is an arbitrarily assigned reference value for the evanescent-mode coupling length, $l_{g,e}$, and the stub's characteristic impedance and associated wave propagation factor are given by $$Z_{g,j} = \bar{Z}_{g,j}\frac{l_{g,e}}{\bar{l}_{g,e}} \tag{13}$$

$$\beta_{g,j} = \frac{2\pi f\sqrt{\bar{\varepsilon}_{r,j}}}{c} \tag{14}$$

with $\bar{l}_{g,e}$ representing the effective stub length. The stub behaves like a waveguide with transverse electromagnetic fields. Assuming adjacent ridges to be of identical cross section, the effective stub length equals the physical height of the ridges plus an empirical correction term that scales with the coupling length of the evanescent-mode waveguide according to $$\tilde{l}_{g,j} = b_{g,e} - s_{g,r} + \bar{d}_{g,j}\left(\frac{\bar{l}_{g,e}}{l_{g,e}}\right)^{\bar{q}_{d,j}} \tag{15}$$

The model parameters $\bar{C}_{s,j}$, $\bar{Z}_{g,j}$, $\bar{\epsilon}_{r,j}$, and $\bar{q}_{d,j}$, are assumed to be design-invariant quantities. Their values are determined, together with the values of previously defined design-invariant parameters, through curve fitting of equivalent-circuit response characteristics to relevant data obtained with the help of electromagnetic field simulation.

Again using the physical dimensions and material parameters associated with the filter example further described below to illustrate the modeling process, an equivalent-circuit of an evanescent-mode coupling section is derived, following earlier guidelines. With the waveguide height kept at $b_{g,e}=b_{g,e}=12$ mm, the evanescent-mode coupling length, $l_{g,e}$, serves as the primary coupling-section design variable, with an arbitrarily assigned reference value of $\bar{l}_{g,e}=3$ mm. The evanescent-mode waveguide width, $a_{g,e}$, with an assigned reference value of $\bar{a}_{g,e}=15.6$ mm, is used as a subordinate design variable. Obtained values of pertinent design-invariant model parameters are, in order of first appearance: $\bar{r}_{m,e}=0.27$, $\bar{Z}_{g,e}=49.44\Omega$, $\bar{\epsilon}_{r,e}=15.00$, $\bar{f}_{c,e}=2.02$ GHz, $\bar{C}_{p,j}=0.41$ pF, $\bar{C}_{s,j}=0.19$ pF, $\bar{Z}_{g,j}=115.70\Omega$, $\bar{\epsilon}_{r,j}=6.00$, $\bar{d}_{g,j}=2.51$ mm, and $\bar{q}_{d,j}=0.99$.

Figure 5:
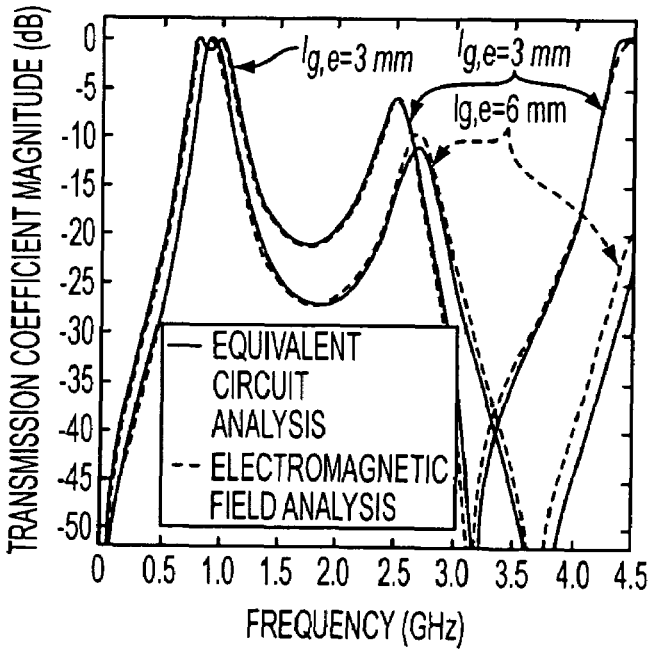
FIG. 5 is a graph showing transmission magnitude characteristics of an evanescent-mode inter-resonator coupling section for two different values of evanescent-mode waveguide length according to the invention.

To demonstrate how well the simple model captures the relevant features of the coupling gap, model-derived transmission-coefficient magnitude responses are compared in FIG. 5 to corresponding 50-Ω-normalized results obtained with the electromagnetic field simulator for $a_{g,e}=\bar{a}_{g,e}$ and representative coupling gap lengths, $l_{g,e}$, of 3 mm and 6 mm. The plotted results again include the effects of the port adapters, which consist of the same ridge-to-strip transitions as in the previous case, each augmented by 18-mm-long connecting sections of single-ridge waveguide. Pertinent auxiliary equivalent-circuit elements are subsequently stripped away to yield a core model for only the coupling region in accordance with FIG. 4.

Wave portions propagating in vertical direction, as represented in the model by the series-connected short-circuited transmission line stub, are largely responsible for the rejection notch observed in the plotted response characteristics. The notch occurs when the equivalent stub, acting in conjunction with parasitic reactances, is effectively a quarter of a wavelength long. For relatively tall waveguide structures, such as in the present example, inclusion of the stub in the model is recommended. The empirically determined factor, $\bar{r}_{m,e}$, provides, thereby, a rudimentary means of apportionment between the main longitudinally propagating evanescent mode and the vertically propagating secondary mode. In situations where the adjoining ridge waveguide sections are appreciably less than a quarter of a wavelength in effective height and the rejection notch lies outside the frequency range of interest, the stub may be omitted from the model, as the remaining equivalent-circuit elements tend to provide sufficient degrees of freedom to adequately describe coupling-section behavior.

Port Launcher

Figure 6:
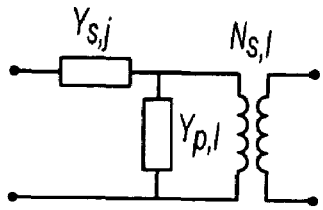
FIG. 6 is an equivalent circuit of a transition from microstrip to ridge waveguide with series-connected-reactance coupling according to the invention.

An equivalent circuit containing a shunt reactance in combination with an ideal transformer as depicted in FIG. 6 may be used to represent the transition from a microstrip feeder line to an end resonator of a ridge waveguide filter at its input port and its output port. Additional circuit elements are typically needed to obtain a good broadband impedance match at each filter port. The elements may comprise a cascade of stepped-characteristic-impedance stripline or microstrip sections, or just one series-connected circuit element. For compactness, the latter configuration is used here, assuming the form of a quasi-lumped, parallel-plate capacitor, as indicated in FIG. 1.

With $h_{s,l}$ denoting the height of the microstrip feeder line over the bottom ground-plane surface—that is, the total physical thickness of the feeder-line substrate—the values of the equivalent-circuit elements can be expressed as $$Y_{p,l} = j2\pi f\bar{C}_{p,l}\left(1 + \bar{g}_{c,l}\frac{h_{s,l} - s_{g,r}}{\bar{s}_{g,r}}\right) - \frac{j}{2\pi f\bar{L}_{p,l}}\left(1 - \bar{g}_{l,l}\frac{h_{s,l} - s_{g,r}}{\bar{s}_{g,r}}\right)^{-1} \tag{16}$$

$$Y_{s,l} = \frac{j}{Z_{g,l}}\cdot\frac{2\pi f\bar{C}_{f,l}Z_{g,l} + \tan(\beta_{g,l}l_{g,l})}{1 - 2\pi f\bar{C}_{f,l}Z_{g,l}\tan(\beta_{g,l}l_{g,l})} \tag{17}$$

$$N_{t,l} = \bar{N}_{t,l}\left(1 + \bar{g}_{n,l}\frac{h_{s,l} - s_{g,r}}{\bar{s}_{g,r}}\right) \tag{18}$$

where the parallel-plate capacitor is represented by a strip transmission line section of effective characteristic impedance $Z_{g,l}$, strip length $l_{g,l}$, strip width $w_{g,l}$, and plate spacing $d_{g,l}$, with $$Z_{g,l} = \bar{Z}_{g,l}\frac{\bar{w}_{g,r}d_{g,l}}{w_{g,l}\bar{d}_{g,l}},\ d_{g,l} << w_{g,l} \tag{19}$$

and the associated propagation factor given by $$\beta_{g,l} = \frac{2\pi f\sqrt{\bar{\varepsilon}_{r,l}}}{c} \tag{20}$$

Design-invariant parameters, listed in sequence of appearance, include $\bar{C}_{p,l}$, $\bar{g}_{c,l}$, $\bar{L}_{p,l}$, $\bar{g}_{l,l}$, $\bar{C}_{f,l}$, $\bar{N}_{t,l}$, $\bar{g}_{n,l}$, $\bar{Z}_{g,l}$, and $\bar{\epsilon}_{r,l}$. As in the two preceding cases, these empirical quantities are derived through a standard process of fitting equivalent-circuit responses to counterparts calculated with an electromagnetic field simulator. The quantity $\bar{d}_{g,l}$ denotes a conveniently chosen reference value for the parallel-plate-capacitor spacing, with quantities $s_{g,r}$, $\bar{s}_{g,r}$ and $\bar{w}_{g,r}$ having been defined earlier.

Figure 7:
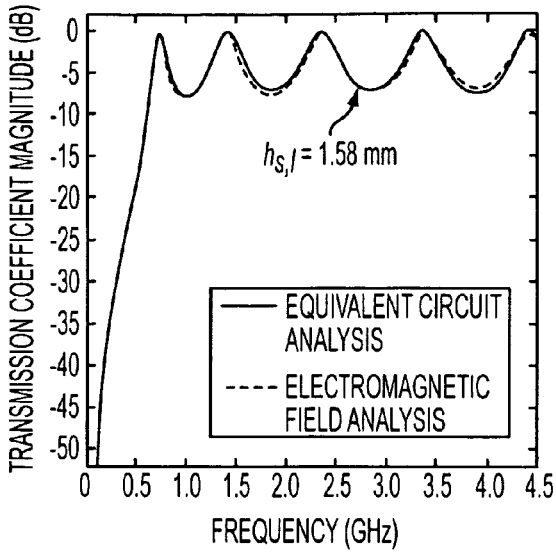
FIG. 7 is a graph showing transmission magnitude characteristics of a transition from microstrip to single-ridge waveguide according to the invention.

The launcher model derived for illustration purposes assumes that the single-ridge waveguide section to which the launcher connects has the same nominal cross-sectional dimensions given above. Values of other quantities with arbitrarily preset values include $l_{g,l}=\bar{l}_{g,l}=8.4$ mm and $\bar{d}_{g,l}=0.25$ mm. The equivalent-circuit responses are simultaneously fit to responses calculated with the electromagnetic field simulator for two different cases—one with $h_{s,l}=1.20$ mm, equaling the nominal ridge gap spacing, and the other with $h_{s,l}=1.58$ mm, corresponding to the nominal ridge gap spacing plus the thickness of a 0.015-inch-thick alumina substrate later used as overlay in the experimental filter presented below. By adapting the width of the microstrip feeder line, its characteristic impedance is kept invariant and equal to 50Ω. To derive the equivalent circuit, a pair of identical launchers is connected back-to-back through a 36-mm-long section of single-ridge waveguide of nominal cross section. Model-predicted and field-analysis-based transmission-coefficient magnitude responses for this combination are compared in FIG. 7. Only the curves for $h_{s,l}=1.58$ mm are actually plotted, as the two sets of responses are bunched very tightly and would be difficult to distinguish in the drawing. In this example, the value of $s_{g,r}$ is held constant at 1.2 mm. The obtained values of the design-invariant model parameters, listed in the same sequence as before, are $\bar{C}_{p,l}=0.73$ pF, $\bar{g}_{c,l}=1.02$, $\bar{L}_{p,l}=3.83$ nH, $\bar{g}_{l,l}=0.15$, $\bar{C}_{f,l}=0.45$ pF, $\bar{N}_{t,l}=1.02$, $\bar{g}_{n,l}=0.09$, $\bar{Z}_{g,l}=5.92\Omega$, and $\bar{\epsilon}_{r,l}=9.9$.

Experiment A

Figure 8:
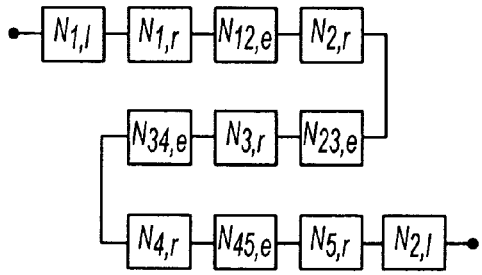
FIG. 8 is a block diagram of an experimental five-pole bandpass filter according to the invention.

The block diagram of a first experimental five-pole bandpass filter used to demonstrate the technique is shown in FIG. 8. The filter exhibits a nominal passband width of 1-1.45-GHz and is assembled from building blocks described above. The filter comprises a symmetric arrangement of five single-ridge waveguide segments, labeled $N_{1,r}$ through $N_{5,r}$, four evanescent-mode coupling sections, labeled $N_{12,e}$ through $N_{45,e}$, and series-capacitance-coupled microstrip port launchers, labeled $N_{1,l}$ and $N_{2,l}$. Cross-sectional dimensions held constant throughout the design process include: $a_{g,r}=\bar{a}_{g,r}=30$ mm, $b_{g,r}=\bar{b}_{g,r}=12$ mm, $w_{g,r}=\bar{w}_{g,r}=6$ mm, $s_{g,r}=\bar{s}_{g,r}=1.2$ mm, $a_{g,e}=\bar{a}_{g,e}=15.6$ mm, $b_{g,e}=\bar{b}_{g,r}=12$ mm, $w_{g,l}=w_{g,r}=6$ mm, $d_{g,l}=\bar{d}_{g,l}=0.25$ mm, and $h_{s,l}=\bar{h}_{s,l}=1.58$ mm. Resonator cavities and evanescent-mode waveguide segments, alike, are filled with custom-formulated Eccostock® CK, a moldable low-loss dielectric material available from Emerson and Cuming Microwave Products, Incorporated. The material consists of a styrene-butadiene polymeric resin and dielectric fillers, e.g. titanium dioxide and/or silica. For the entire 1.2-mm-thick region underneath the ridges, extending over the full respective widths and lengths of pertinent waveguide sections, such material with a nominal relative dielectric constant of 15 is employed. The relative dielectric constant in all other internal regions is 6.

Figure 9:
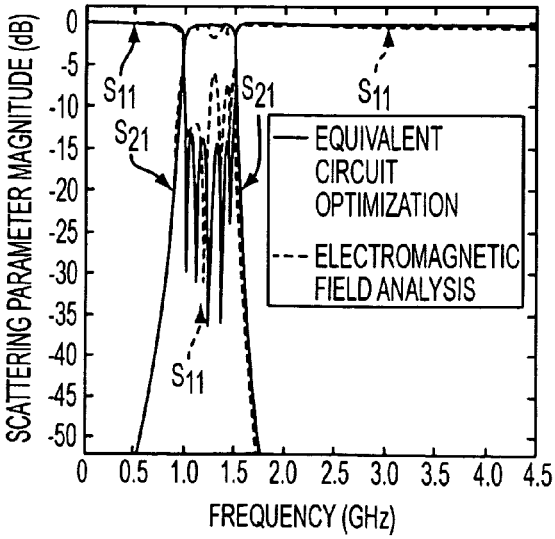
FIG. 9 is a graph showing transmission-coefficient and reflection-coefficient magnitude responses of a filter as in FIG. 8, comparing the initial solution obtained through equivalent-circuit-based numerical optimization to the results of electromagnetic field analysis performed on the same structure, according to the invention.

Numerical equivalent-circuit-based filter optimization yields ridge waveguide resonator lengths $l_{g,r}^{1}=l_{g,r}^{5}=6.30$ mm, $l_{g,r}^{2}=l_{g,r}^{4}=5.25$ mm, and $l_{g,r}^{3}=5.12$ mm. Associated inter-resonator coupling lengths are $l_{g,e}^{12}=l_{g,e}^{45}=3.92$ mm and $l_{g,e}^{23}=l_{g,e}^{34}=5.18$ mm. The length, $l_{g,l}$, of the vertically positioned parallel-plate transmission lines functioning as port coupling capacitors is 7.76 mm. The filter's equivalent-circuit-derived transmission- and reflection-coefficient magnitude responses based on these numbers are shown in FIG. 9, together with the corresponding responses predicted by the electromagnetic field simulator for the same set of numbers. Despite the fact that the simple component models largely ignore interactions among waveguide-junction evanescent fringing fields, the agreement is found to be remarkably good, especially when considering the relatively short lengths of waveguide that separate individual junctions. Relying on the obtained set of length values as an attractive starting solution, three iterative rounds are subsequently employed in accordance with the refinement procedure outlined above. Sequentially fitting the filter's equivalent-circuit response characteristics to a solution previously provided by the electromagnetic field simulator yields continuously improved sets of length values. For the iterative process to converge, the equivalent circuit of the filter need only provide reasonably reliable gradient information to direct the refinement process, without actually having to intrinsically exhibit the same degree of accuracy sought for the final solution.

The refined waveguide length values obtained in this straightforward manner are $l_{g,r}^{1}=l_{g,r}^{5}=5.02$ mm, $l_{g,r}^{2}=l_{g,r}^{4}=5.42$ mm, $l_{g,r}^{3}=5.14$ mm, $l_{g,e}^{12}=l_{g,e}^{45}=3{,}95$ mm, $l_{g,e}^{23}=l_{g,e}^{34}=5.00$ mm, and $l_{g,l}=8.50$ mm. Comparing these values with the before-listed starting values indicates that the refinement process centers mainly on the immediate vicinity of the launcher, where field patterns are most inhomogeneous. Cross-sectional views of the demonstration hardware, based on the revised numbers, are given in FIG. 10. The actual device length is 56.6 mm (excluding coaxial connectors) and comprises two clam-shell-type cavity structures machined from aluminum and clamped tightly together with screws. Referring again to FIG. 1, the cavity recesses (lower and upper, referring to the two respective structures) are back-filled with moldable material of relative dielectric constant 15 and 6, respectively. The measured transmission- and reflection-coefficient magnitude responses of the assembled experimental filter are presented in FIG. 11, where they are compared to the responses predicted by the electromagnetic field simulator. In contrast to the calculations performed in support of model derivations and equivalent-circuit refinements, where loss effects are ignored for the sake of computational efficiency, the final calculations depicted in FIG. 11 do include the effects of both metal and dielectric losses. The latter are represented by a loss tangent of 0.002.

The observed agreement between the two sets of curves is good, especially considering that no post-fabrication modification was applied to the filter structure. The predicted maximum passband insertion loss of 0.45 dB, including the coaxial-to-microstrip port adapters, proved to be accurate. It should also be noted with regard to the general characteristics that the upper stopband extends beyond 4.5 GHz, a full three times the passband's upper edge frequency.

It is also noted that other suitable filter configurations are possible in addition to those illustrated in FIGS. 1 and 8. Accordingly, although the ridge and evanescent sections are shown positioned along opposing perimeters of filter 10, for example approximately parallel to a longitudinal axis of the device, it should be understood that the invention also includes embodiments where waveguide sections and port matching networks are not physically arranged in-line. For example, waveguide segments could be folded or otherwise arranged at odd angles to conserve space or conform to a special application, with a filter still behaving electrically as if its sections were arranged in-line as in FIG. 8.

Experiment B

Figure 10:
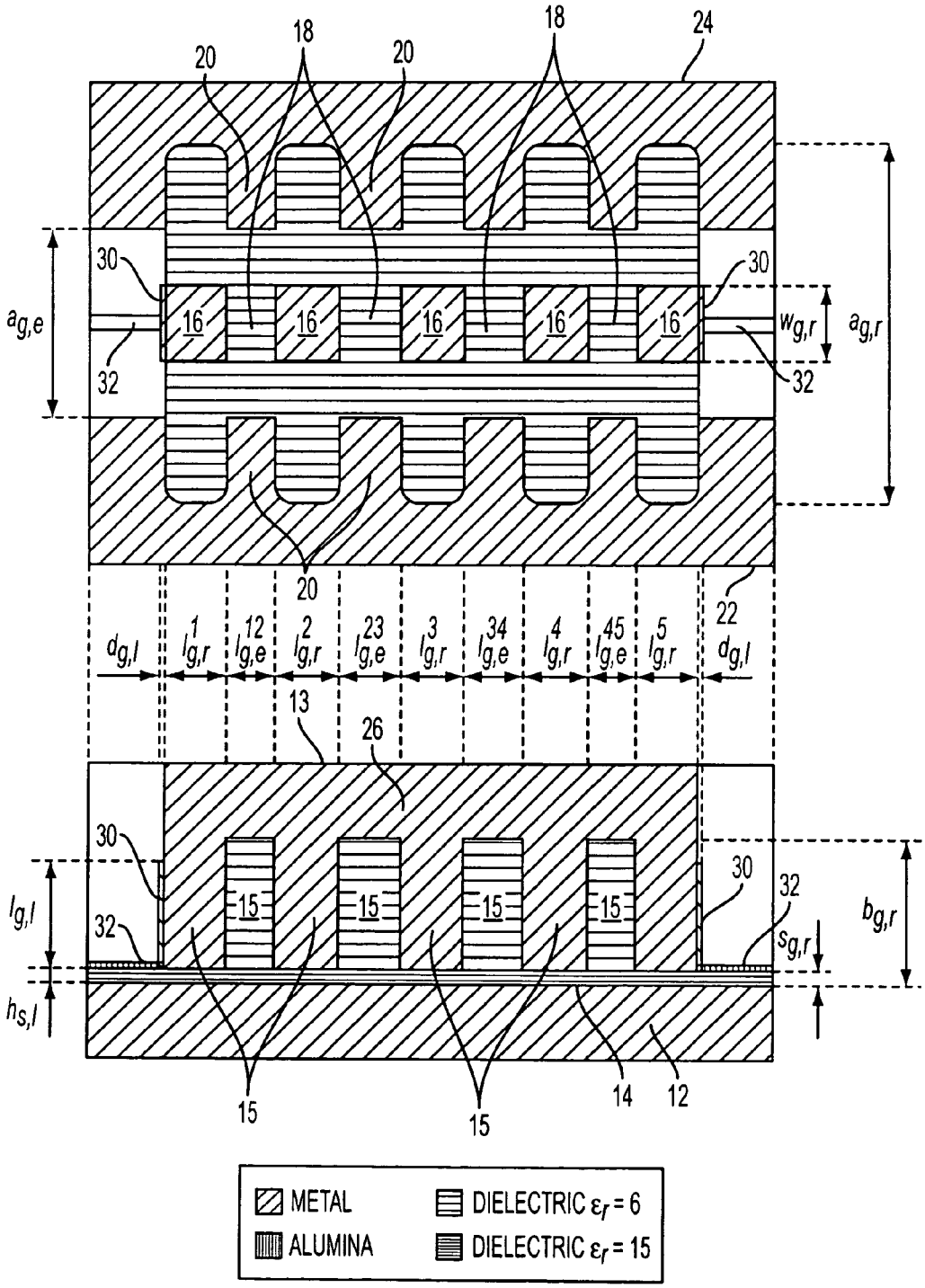
FIG. 10 illustrates horizontal (top figure) and vertical (bottom figure) cross-sectional views of a filter as in FIG. 8 according to the invention.
Figure 11:
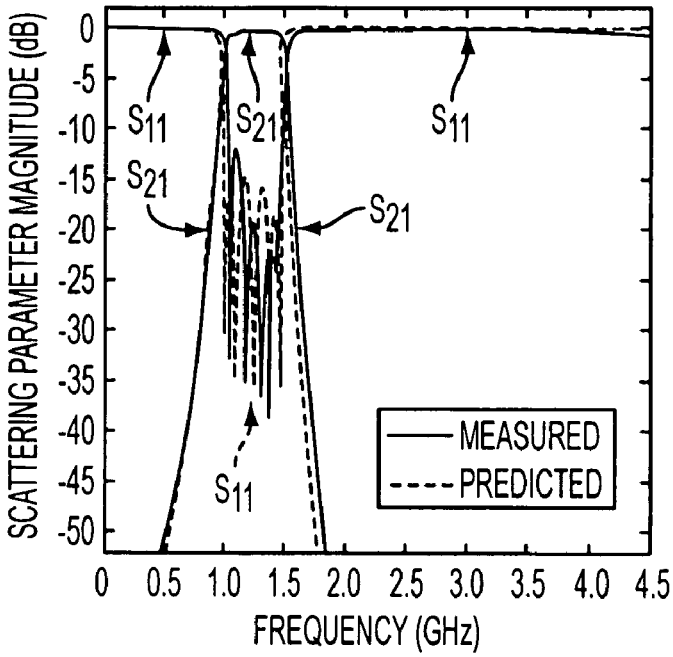
FIG. 11 is a graph showing transmission-coefficient and reflection-coefficient magnitude final responses of a filter as in FIG. 8, with measurements compared to predictions generated with the electromagnetic field simulator, according to the invention.
Figure 12:
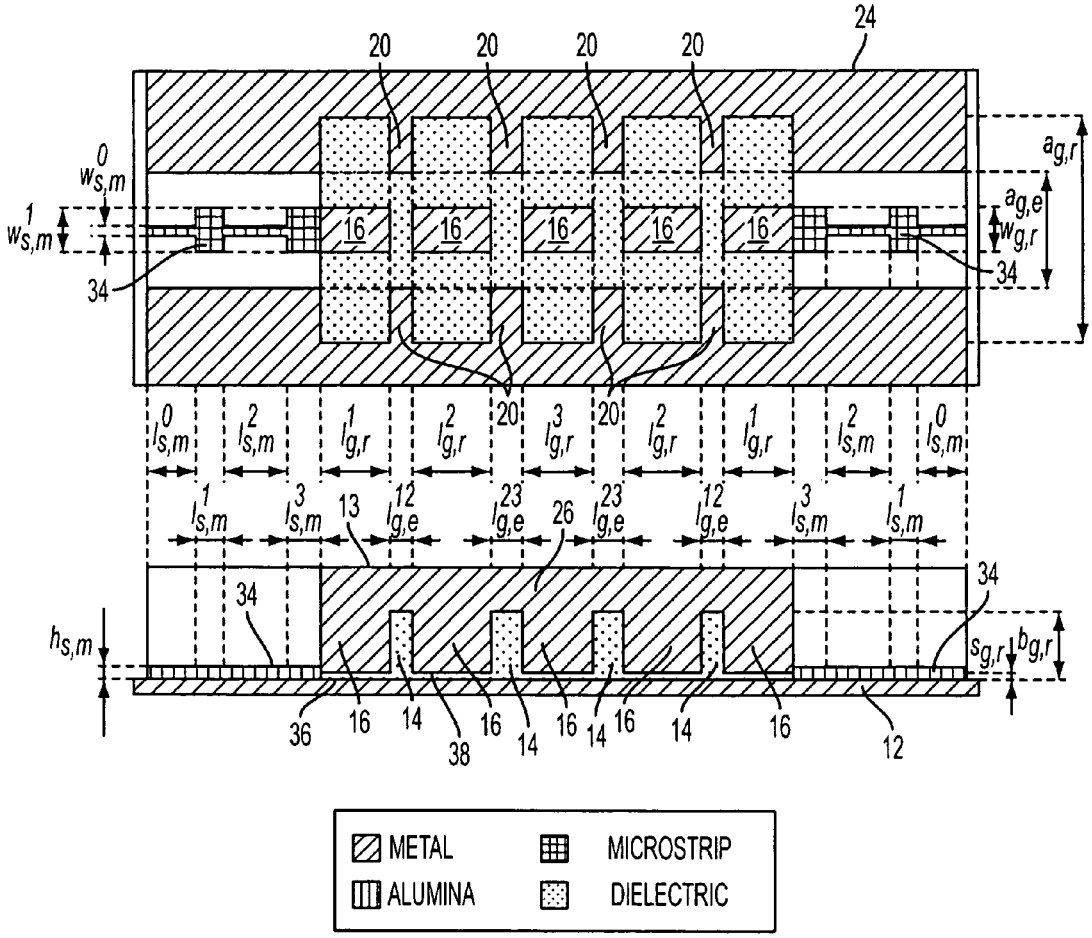
FIG. 12 illustrates horizontal (top figure) and vertical (bottom figure) cross-sectional views of a 6-8.6-GHz bandpass filter drawn to scale, with cross-sectional planes positioned at half height and half width, respectively, according to the invention.

The technique is further demonstrated with a second experimental five-pole bandpass filter that exhibits a 6-8.6-GHz passband width and is configured according to the same generic block diagram of FIG. 8 as in Experiment A. The cross-sectional views of filter 100 are represented in FIG. 12, where the structural components are the same as illustrated in FIG. 1 and FIG. 10 save for microstrip port matching circuits 34 replacing former series capacitors 30 and microstrip feeder lines 32, and a solid dielectric core of one material replacing former dielectric layers 14 and 15 of differing materials. Referring to FIG. 12, as above, $a_{g,r}$, $a_{g,e}$, and $b_{g,r}$ represent ridge-waveguide width, evanescent-mode-waveguide width, and common waveguide height, respectively, $l_{g,r}^1$, $l_{g,r}^2$, $l_{g,r}^3$, and $l_{g,e}^{12}$, $l_{g,e}^{23}$ denote respective ridge-waveguide and evanescent-mode-waveguide lengths, $w_{g,r}$ refers to ridge width, and $s_{g,r}$ to ridge gap spacing. The ratio of waveguide height $b_{g,r}$ to waveguide width $a_{g,r}$ was chosen to be less than in the lower-frequency Experiment A. With the filter's waveguide ridges to be realized by forming precision blind holes within a solid dielectric core and subsequently metallizing the core from the outside, it was advantageous to minimize the depth of the holes—and thus the height of the composite filter structure—to keep mechanical-tolerance-induced aberrations within acceptable bounds. With reference to the evanescent-mode coupling-gap model depicted in FIG. 4, and the series-connected stub contained therein and described by Equations (12)-(15), the height reduction led to a decrease in the equivalent stub electrical length for each of the filter's coupling gaps. This shifted the associated transmission nulls, akin to those in FIG. 5, to higher frequencies, partially denying stopband benefits that might have been derived from the presence of such nulls. A resultant slight decrease in obtainable fractional stopband width proved acceptable, however, while still permitting the filter's upper stopband to extend to 22 GHz, as specified by the application.

In return, the reduction in waveguide height brought about simpler filter-internal electromagnetic field patterns that translated into enhanced computational efficiency. The fields propagating vertically in a combine-type fashion along the vertical faces of respective waveguide ridges became thus primarily governed by the fields propagating in the direction of the filter's main longitudinal axis. This led to a subordinate role for the series-connected stub in the evanescent-mode coupling-gap model.

Unlike the first experimental filter discussed above, a single dielectric fill material with a relative dielectric constant $\epsilon_r$ of 9.5 was applied as layer 14. Impedance-matching networks are typically used to connect a filter's ridge-waveguide end resonators to external 50-Ω ports. Planar-circuit configurations offer an effective means for providing both needed impedance transformation and compensation for parasitic reactance effects at transition interfaces. Among the simplest solutions are cascades of strip transmission line sections with stepped characteristic impedances. As indicated in FIG. 12, a microstrip format was chosen with pertinent strip widths and lengths labeled $w_{s,m}^0$, $w_{s,m}^1$, and $l_{s,m}^0$, $l_{s,m}^1$, $l_{s,m}^2$, $l_{s,m}^3$, respectively. The thickness of the microstrip substrate is denoted $h_{s,m}$.

In its other aspects, the design process was as discussed above, including the derivation of equivalent circuits for each of the filter's main components based on the results of three-dimensional electromagnetic structure simulations, the construction of an equivalent circuit for the composite filter from the derived component equivalent circuits, the equivalent-circuit-based numerical optimization of the filter's port characteristics, and iterative rounds of refinement that involved convergent reconciliation between results predicted by the electromagnetic structure simulator and results predicted by the filter's equivalent circuit. The optimized parameter values thus obtained for the experimental 6-8.6-GHz bandpass filter have been collected in the first numerical column of Table I.

TABLE I

STRUCTURAL DIMENSIONS IN MICROMETERS OF THE EXPERIMENTAL 6-8.6-GHz BANDPASS FILTER AND THE SUPPLEMENTAL 8.6-11-GHz AND 11-18-GHz FILTER DESIGNS

| Parameter | 6-8.6-GHz Filter | 8.6-11-GHz Filter | 11-18-GHz Filter |
|---|---|---|---|
| $a_{g,r}$ | 5000 | 4500 | 4000 |
| $b_{g,r}$ | 1500 | 1250 | 1000 |
| $w_{g,r}$ | 1000 | 900 | 800 |
| $s_{g,r}$ | 125 | 150 | 225 |
| $a_{g,e}$ | 2600 | 2500 | 2400 |
| $b_{g,e}$ | 1500 | 1250 | 1000 |
| $l_{g,r}^1$ | 1570 | 1255 | 975 |
| $l_{g,r}^2$ | 1695 | 1010 | 900 |
| $l_{g,r}^3$ | 1610 | 890 | 810 |
| $l_{g,e}^{12}$ | 490 | 730 | 405 |
| $l_{g,e}^{23}$ | 650 | 1080 | 595 |
| $h_{s,m}$ | 254 | 254 | 254 |
| $w_{s,m}^0$ | 110 | 110 | 105 |
| $w_{s,m}^1$ | 1000 | 900 | 800 |
| $l_{s,m}^0$ | 1000 | 1000 | 1000 |
| $l_{s,m}^1$ | 660 | 770 | 310 |
| $l_{s,m}^2$ | 1425 | 1265 | 800 |
| $l_{s,m}^3$ | 660 | 770 | 310 |
| $\epsilon_r$ | 9.5 | 9.5 | 9.5 |

Fabrication

A first fabrication attempt involved the machining of a filter dielectric core from a slab of magnesium-aluminum-titinate ceramic material in its fully fired state. A laser-based method was initially thought to offer the best chance of success, chosen from a number of contending precision-machining techniques. The most challenging operation was the machining of blind holes with rectangular cross sections and sharp edges that, following the external metallization of the finished core, would become the filter's waveguide ridges. The crux was to achieve hole bottoms that were flat and smooth, as these would define critical ridge gap spacings. In the end, despite concerted design efforts to minimize required hole depths, the laser beam could not be focused tightly enough to achieve acceptable bottom surfaces at needed depths in excess of 1 mm.

Figure 13:
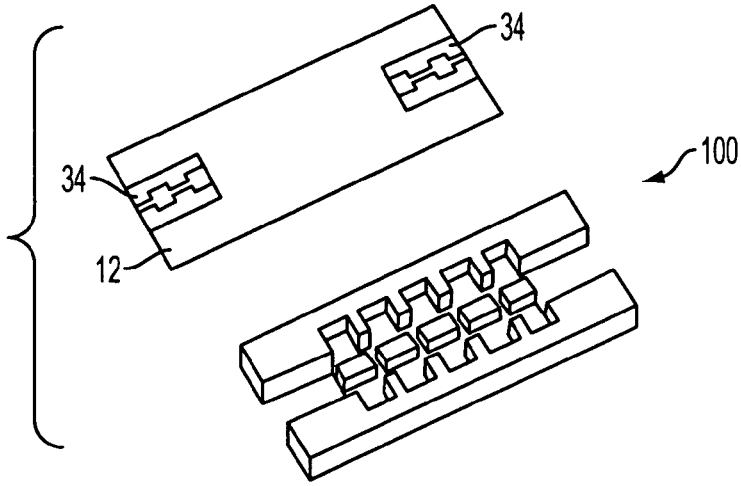
FIG. 13 illustrates an exposed filter cavity structure (bottom figure)—prior to backfill with moldable dielectric material—alongside its carrier plate (top figure) with positioned port impedance-matching circuits, according to the invention.

The approach that was finally taken constituted essentially the inverse of the former, involving wire electric discharge machining to cut the filter's compound cavity out of solid metal, and using moldable dielectric material as backfill. The structure was actually machined as two separate pieces that were subsequently brazed to form a composite unit. Referring now to FIG. 12, a first piece of filter 100 comprised the waveguide cavities' common roof 13 and the filter's five stalactite waveguide ridges 16. A second piece assumed the shape of a frame that defined the evanescent-mode constrictions 20 and the structure's vertical outer conducting cavity walls 22 and 24. After brazing, the pieces were joined into an assembly with a combined outer housing surface plated with 3-μm-thick gold, and the flange area at ground-plane level 36 was resurfaced to achieve a consistent 125-μm ridge gap 38 spacing, as required by the design parameters. An illustration of the precision-machined filter 100 structure in an inverted position is shown in FIG. 13, together with the filter's carrier plate 12 and temporarily positioned microstrip port matching networks 34.

The resultant hollow cavity structure was backfilled with Eccostock-CK® which was formulated to exhibit a desired nominal relative dielectric constant of 9.5. Among the material's attractive attributes are its stated loss tangent of less than 0.002 and the absence of shrinkage during the curing process. Excess material was lapped off to establish a flat surface at ground-plane level.

Next, the backfilled structure was supplied with a conducting ground plane. This was achieved through e-beam evaporation of a 0.015-μm-thick adhesion layer of chromium and a 2-μm-thick layer of gold, thereby guaranteeing a solid galvanic connection between ground plane and cavity walls, and completing the outer housing surface 26. Resonator end faces were masked off during the evaporation process.

Figure 14:
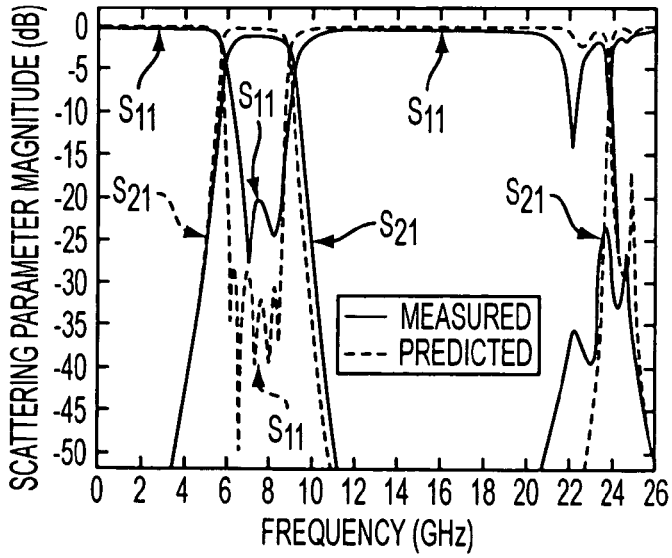
FIG. 14 is a graph showing the measured and predicted responses of a filter as in FIG. 12 according to the invention.

The finished cavity structure and the small alumina substrates with microstrip port matching circuits were then attached to a common metal carrier as illustrated in FIG. 1. This was accomplished by applying a constant-thickness layer of conductive epoxy to the carrier's top surface, and then dropping the cavity structure and the microstrip substrates in place. For the application of the conductive epoxy, a framed printing screen supplied by SEFAR Printing Solutions, Inc., Burnsville, Minn., was employed, comprising a mesh of taught stainless steel wires of 0.0011-inch diameter, with a density of 325 wires per inch. The microstrip impedance-matching circuits were connected to the external faces of the filter's end-resonator waveguide ridges with the help of small pieces of angled gold foil that were ultrasonic-wedge bonded to the microstrip end lines and attached with conductive epoxy to the vertical ridge faces, respectively. The fully assembled filter module was mounted in a test fixture and connected to coaxial 50-Ω SMA launchers. Predicted and measured port characteristics of the ensemble are compared in FIG. 14. The observed agreement between measured and predicted results is very good. This includes the reproduction of resonances within the upper satellite passband. Minor discrepancies may be attributed to general machining tolerances, as although mechanical tolerances are preferably below ±10 μm, actual dimensional deviations were ±25-30 μm, and randomly distributed. This along with the test fixture's standard-issue subminiature A (SMA) port connectors appears to account for apparent frequency shifts in filter reflection-coefficient nulls. The small extra hump in the satellite passband was traced to parasitic signal feed-through within the test fixture, not the filter module itself.

Comparing the predicted mid-passband transmission loss of 0.6 dB to the measured value of 1.3 dB, it is believed that at least 0.2 dB of the latter can be attributed to the neglected effects of the two SMA connectors. This leaves 0.5 dB to have been caused by the aggregate effects of tolerance-induced shifts in filter characteristic frequencies, imperfect metal surfaces and ridge edges, fabrication-related lower-than- anticipated metal conductivities, and a ground-plane metallization thickness of only two skin depths at passband frequencies.

Figure 15:
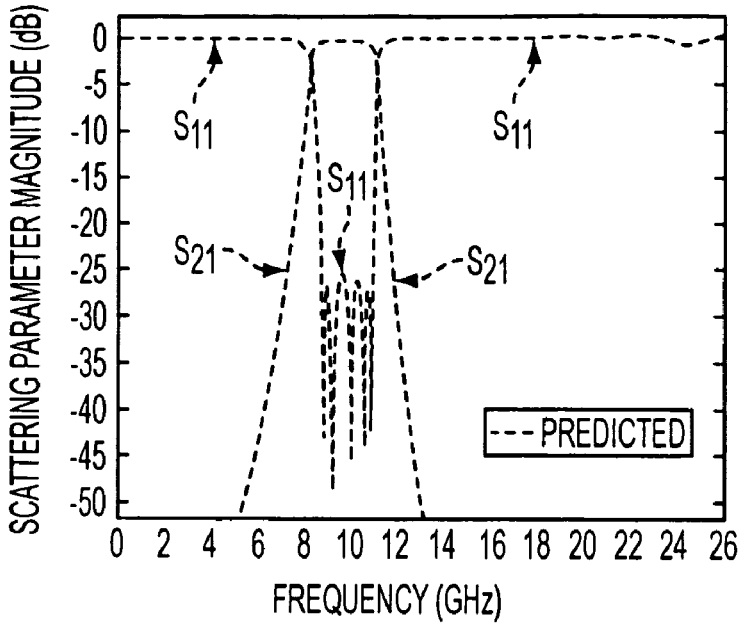
FIG. 15 is a graph showing the calculated response of a 8.6-11 GHz bandpass filter according to the invention.
Figure 16:
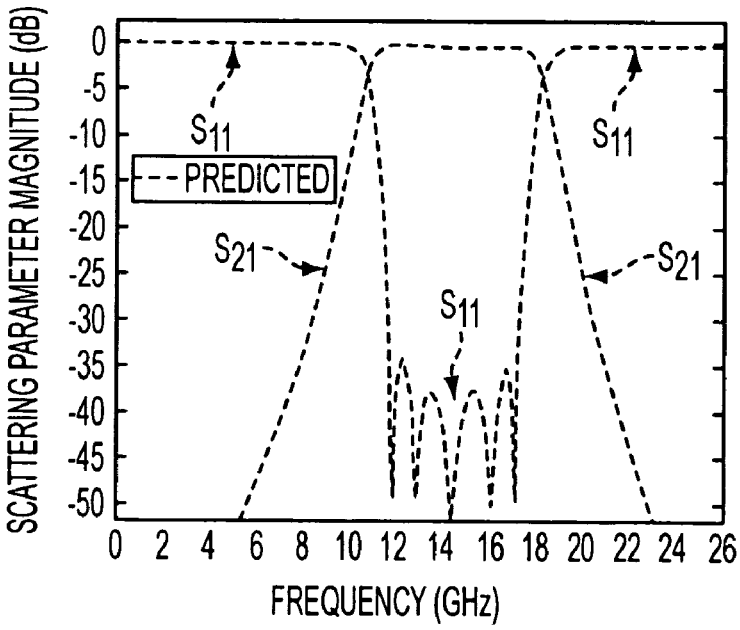
FIG. 16 is graph showing the calculated response of a 11-18 GHz bandpass filter according to the invention.

To further illustrate the approach, the calculated port responses of two additional filter designs with contiguous passbands are provided in FIG. 15 and FIG. 16, respectively. The associated structural dimensions can be found in Table I. As in the 6-8.6-GHz-passband case, both metal and dielectric losses were included in the calculations, but not the effects of coaxial external connectors. The additional designs also employ a single dielectric material for the sake of expediency.

When contemplating filter configuration options, there is no fundamental prerequisite that the width $a_{g,e}$ of the evanescent-mode waveguide coupling sections be narrower than the width $a_{g,r}$ of adjacent ridge-waveguide segments, as the three design examples might suggest. To substantiate this, numerical designs for five-pole ridge-waveguide filters that did not utilize constrictions in the coupling areas were derived, using the exact same design methodology. Associated performance characteristics were found to be consistent with those of the examples reported here. However, in order to maintain proper inter-resonator coupling, increases in the lengths of the evanescent-mode waveguide sections were required, adding noticeably to the overall length of each filter. In return, respective passband-insertion-loss numbers were projected to be slightly lower. Within practical bounds, this offers an opportunity for trade-offs among filter size, circuit performance, and manufacturing effort.

Alternative ways of fabricating ridge-waveguide filters include low-temperature-cofired-ceramic (LTCC) processes. Such processes are well established and can be quite cost-effective. An often-expressed concern, though, relates to the accuracy with which a filter design can be reliably reproduced. The concern is of a compound nature, as it encompasses the necessity to dependably predict the amount of substantial shrinkage that occurs during the firing of the material, deal with a degree of uncertainty surrounding the exact value of the fired material's dielectric constant, and accommodate relatively large fabrication tolerances on the placement of via holes. This last issue can pose a particular problem when using arrays of vertical via holes in conjunction with buried conductive strips to approximate waveguide ridges. Designers are often encouraged to slightly offset via hole arrays toward the centers of respective strips to facilitate the definition of critical ridge edges, but at the risk of increasing a structure's dissipation loss and reducing its power handling capability due to potentially higher strip-edge current concentrations. LTCC-implemented ridge waveguide that employs via-hole arrays already tends to exhibit higher dissipation loss than is encountered in comparable ridge waveguide with solid-metal walls. In addition, LTCC processes do not lend themselves well to the practical realization of commonly desired rounded ridge edges for the reduction of dissipation loss, something that is simple to accommodate in structures that utilize moldable dielectric materials.

A preferred fabrication of cost-effective filters is in the form of monolithic ridge-waveguide structures made of cast dielectric material with selective external metallization. This permits a filter's planar-circuit port impedance-matching networks to also be included as part of the monolithic unit by extending connected end-resonator ridges out to respective external port reference planes and designing the footprints of the ridge extensions to coincide with desired matching-circuit strip patterns. The casting of the dielectric core is followed by the evaporation of a thin layer of precious metal onto the core's entire outer surface and the fortification thereof through electroplating. After mounting the unit on a metal carrier to ascertain structural integrity, excess material is removed from areas above prospective port-matching circuits, leaving low-profile metallized channels to function as strip conductors, and residual dielectric material to serve as substrates. The process simultaneously exposes the dielectric material at the filter's resonator end faces and at its port reference planes, in accordance with design requirements.

The top portion of an applicable die might look similar to an empty cavity structure augmented at both ends to accommodate filter port matching networks. The design should also be modified to include holes for injecting the moldable material, and slanted side walls to facilitate the release of molded cores after curing. Mechanical tolerances remain important, but fortunately, precision milling machines capable of maintaining a general tolerance of ±2.5 μm are commercially available. Other established techniques, such as the use of LIGA molds, may be applied to the fabrication of precision dielectric cores as well.

An important part of the invention discussed above is the available option of simultaneously employing different dielectric materials to form a composite dielectric core structure, in contrast to the common use of merely a single type of dielectric. The overall objective is to optimally distribute electrical fields and the electrical currents associated therewith so as to avoid troublesome high current densities that cause loss. A preferred way to implement the invention is to employ constant-thickness layers of dielectric materials with differing relative dielectric constants, selecting high dielectric-constant materials for regions where electric fields and currents should be concentrated, and low dielectric-constant materials where it is advantageous to keep fields and currents at (relatively) low values. In the case of a ridge-waveguide filter, as illustrated in FIG. 1, it is advantageous to use higher-dielectric-constant material in the gap areas of each ridge guide, between ridge bottom and opposing conducting surface, so as to help redistribute currents that would otherwise highly concentrate at the longitudinal ridge edges. It may be preferable to partially embed ridges in higher-dielectric-constant material to further reduce peak current densities. Lower-dielectric-constant material is beneficial in areas where a high local wave impedance is preferred, as may be desired to help maximize usable guide bandwidth and to render coupling between adjacent resonators easier to realize. Composites of dielectric materials can also be used to relax manufacturing tolerances on structural dimensions.

The ridges of the ridge-waveguide sections are formed by creating depressions of rectangular cross section in the dielectric core, with the depressions subsequently metallized from the outside, as illustrated by the conceptual representation of FIG. 1. The external metallization establishes the electrically conductive internal boundary of the ridge waveguide. In order to simplify the design process while employing an equivalent-circuit representation of the ridge waveguide, the ridge guide sections are preferably chosen to be of uniform cross section. This is not a prerequisite of the invention, though. For a bandpass filter according to the invention, as mentioned earlier, the cross-sectional dimensions of the ridge guide are chosen to place the cutoff frequency of the guide below the lower passband edge and to place the frequency where the next higher-order mode can propagate well above the upper passband edge, so as to assure single-mode operation at all passband frequencies. This is also not an absolute requirement, but simplifies the design process. Given an application-determined maximum permissible waveguide width, the frequency range of single-mode operation can then be set, within practical bounds, by adjusting the gap spacing within the capacitively loaded area under the ridge, the width of the ridge relative to the overall width of the waveguide, the overall height of the waveguide, and the dielectric constant of the dielectric fill material.

A further consideration is the electrical length of a respective ridge waveguide segment in the direction of propagation. It should be made long enough to be reliably represented by an equivalent circuit of a uniform section of waveguide transmission line, augmented by equivalent networks describing the fringe-field regions at both ends of each transmission line section. This is again not a fundamental requirement for the application of the invention, but helps to greatly simplify the design process through the use of simple analytical models. From a power-dissipation point of view, it is also advantageous to avoid making the line lengths too short in order to distribute dissipation over as wide an area as possible, making it easier to accommodate high-power drive conditions. The maximum lengths are essentially determined by how wide the upper stopband region of a bandpass filter is required to be. The shorter the line segments of a filter are, the farther unavoidable parasitic passbands are pushed to higher frequencies, as the filter assumes a more lumped-circuit-element character. The ridge waveguide cross-sectional outline may be further modified to achieve specific attributes, such as the use of slanted vertical walls to ease the release of the dielectric cores from the mold when employing injection molding, or the rounding of sharp conducting edges with elevated current densities to redistribute currents more evenly over the cross section and thereby reduce losses.

Of the two aforementioned options for establishing necessary inter-resonator coupling between two adjacent ridge-waveguide resonator sections, namely the capacitive method and the inductive method, the inductive approach is generally preferred, realized with a cascaded section of evanescent-mode rectangular-cross-section waveguide, as indicated for the two five-pole bandpass filter examples above. To ease concerns about manufacturing tolerances, particularly in bandpass cases with wide passband widths that require tight inter-resonator coupling with very short lengths of evanescent-mode waveguide, it can be advantageous to fill the inter-resonator coupling region with dielectric material having as low a relative dielectric constant as possible in order to increase the physical evanescent-mode guide length for a given electrical length. Such has been attempted, to a large degree, in the conceptual design depicted in FIG. 1 and in the design of Experiment A represented in FIG. 10, where the high-dielectric-constant material is confined to a thin layer at the bottom of the guide, leaving the cross section of the evanescent-mode inter-resonator coupling gap predominantly filled with lower-dielectric-constant material.

As for the choice of evanescent-mode cutoff frequency, it preferably should be placed in the vicinity of the highest stopband frequency of interest or slightly above. This is achieved by choosing the physical width of the evanescent-mode guide to be a half of a wavelength across at the designated cutoff frequency in the pertinent dielectric material. In the prior art, the same physical guide width has generally been maintained for ridge-waveguide and evanescent-mode-guide sections, alike. A special feature of the invention is thus to permit the evanescent-mode waveguide sections to be of lesser width than the ridge-guide sections, without any changes to the above-described design procedure. This is important in situations where extremely wide stopbands are required, as was the case in the filter application that indirectly led to the current invention. This feature conveniently permits the frequency range of single-mode wave propagation in a filter's ridge-guide sections and the frequency range of purely evanescent-mode operation in a filter's evanescent-mode regions to be chosen independently, thereby increasing design flexibility and enhancing the designer's ability to accommodate stringent filter specifications.

The port impedance-matching networks can assume a variety of different forms. Their general purpose is to transform the relatively low characteristic impedance of the ridge waveguide into a nominal 50-ohm driving impedance, consistent with a majority of application requirements. The port networks are also tasked with serving as transitions to external port connectors, often in the form of coaxial connectors. Preferred configurations comprise networks implemented in a microstrip or stripline format. Aside from conventional network segments used to perform impedance transformation, the port networks may also contain additional reactive circuit elements that help compensate for reactive parasitic effects associated with connections to the outermost ridge waveguide sections, thereby facilitating impedance matching at the ports. The series-connected port-coupling capacitors discussed above represent just one example of such additional reactive circuit elements.

The way in which the port networks are connected to the end ridges (those closest to the ports) of a filter represents a further special feature of the invention. The conducting strips of conventional port networks connect directly to the bottoms of a filter's end ridges, where electric field and current patterns approximate those of the adjoining port-network strips. The strips at the connection points are typically of a width equal to that of the end ridges or less. In the current invention, connections to an end ridge may be shifted upwards on the conducting end faces of the ridges, away from the high-field region underneath the ridge and toward the upper, lower-field regions of the waveguide. The shift in attachment point is equivalent to adding an ideal transformer in cascade at that point. Such can provide a substantial part, if not all, of the impedance transformation needed to connect to the outside, without the usual bandwidth limitations of conventional distributed strip-type impedance-transforming networks.

Filters of the kind described above lend themselves well to integration into banks of filters, or so-called frequency multiplexers. Generically, their function is to accept a signal of a given bandwidth and divide it into parts that represent subsets of frequencies contained in the original bandwidth, or alternatively and reciprocally to combine similar subsets into a signal of composite bandwidth. The conventional approach is to establish a trunk-line structure, or manifold, to which individual channel filters are connected at intervals. These intervals often correspond to an effective electrical length that represents an appreciable portion of a wavelength, a half or even a full wavelength. Traditionally, channel filters have been exclusively shunt-connected to the manifold, with the multiplexer's common port usually located closest to the connection point for the highest-frequency filter.

Figure 17:
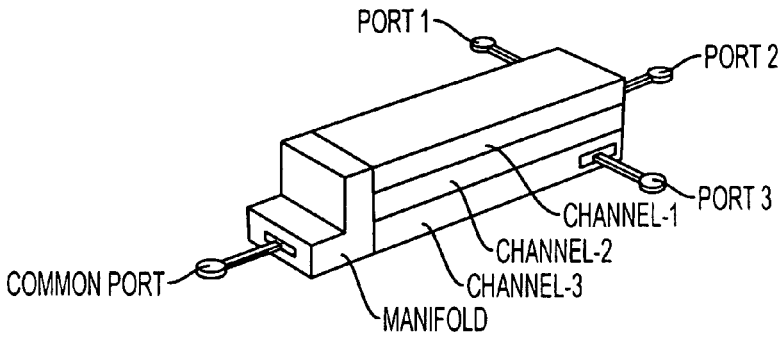
FIG. 17 is a three-channel multiplexer assembly according to the invention.

In contrast, the present invention employs a manifold structure to which pertinent channel filters are series-connected. The densest manner in which to assemble a multiplicity of channel filters of the type described above into a multiplexer is to stack them as illustrated in FIG. 17. Geometric considerations suggest a series-type connection of the channel filters to the manifold as the most compact and logical, albeit difficult to realize solution. The physical implementation is made particularly difficult by the geometric requirement that the physical lengths of the manifold segments be commensurate with the heights of associated channel filter structures. This places severe electrical constraints on the design of the manifold, as the corresponding effective electrical lengths of pertinent manifold segments are required to be considerably shorter than the usually preferred half-to-a-full-wavelength.

Figure 19:
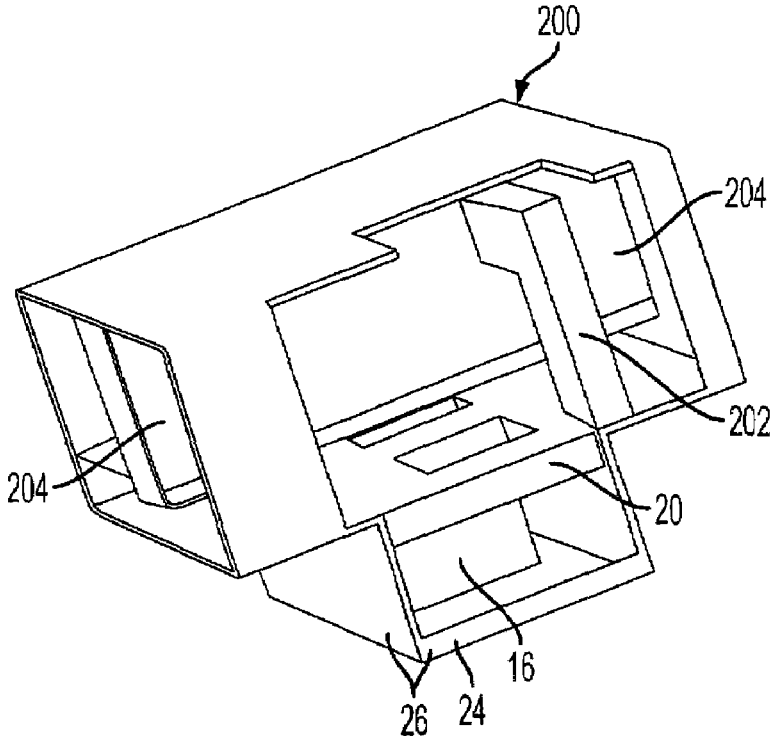
FIG. 19 is a manifold segment including quasi-lumped reactive waveguide components according to the invention.

Referring now to FIG. 19, the dilemma of how to realize manifold segment 200 with considerably longer effective electrical lengths than the physical heights of the (internal) waveguide ports of pertinent series-connected channel filters would normally permit was solved by employing, as manifold segments 200, structures composed of quasi-lumped reactive waveguide components, such as conductive waveguide irises 20 that are cascade-connected to interspersed short segments of uniform waveguide, preferably ridge waveguide 204. These waveguide elements help perform the phase- and impedance-matching functions up and down the manifold structure necessary to establish, among other things, a good impedance match at the common port of the frequency multiplexer for all frequencies of interest. To further support the invariably challenging impedance-matching task, individual channel filters are permitted to deviate from their usual port symmetry, thereby allowing within each filter a gradient in the filter's intrinsic impedance level from its input to its output port. This tends to relax the stringent demands on the waveguide elements comprising the manifold, furthering the physical realizability of the manifold.

Connection to the common port of the multiplexer's manifold can be done in a manner similar to the afore-described method used for individual filters. A respective common-port impedance matching circuit may thus comprise one transmission-line segment connected in cascade to the common port of the manifold, or a cascade-connection of multiple transmission-line segments of differing characteristic impedances. The matching circuit may also contain one or more reactive circuit elements that may be connected in series and/or in parallel to the common manifold port. Reactive circuit elements may include lumped, quasi-lumped, and/or distributed elements. A lumped or quasi-lumped element is, by example, one that can be equivalently represented by a capacitor, an inductor, a pair of mutually coupled inductors, a resistor, or a transformer. Likewise, a distributed element is one that can be equivalently represented by a segment of single transmission line or a plurality of coupled transmission line segments, or by a short- or an open-circuited transmission-line stub. Reactive circuit elements may be implemented in a variety of technologies, including microstrip, stripline, conducting bars of rectangular or other cross section, and/or single-conductor waveguide, including rectangular waveguide and ridge waveguide.

Figure 18A:
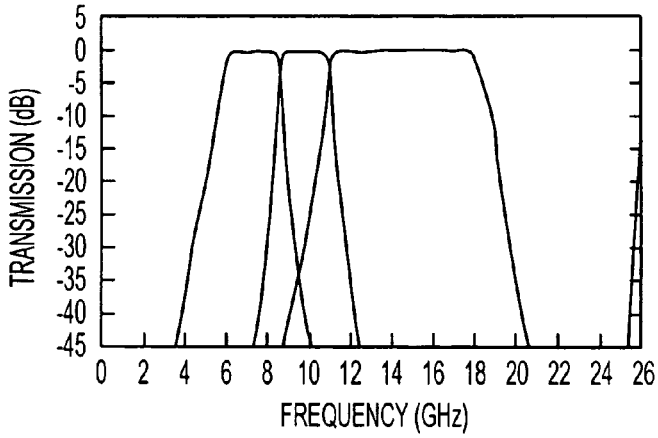
FIG. 18 is a graph showing the predicted signal transmission and reflection response characteristics of the three-channel multiplexer of FIG. 17 according to the invention.
Figure 18B:
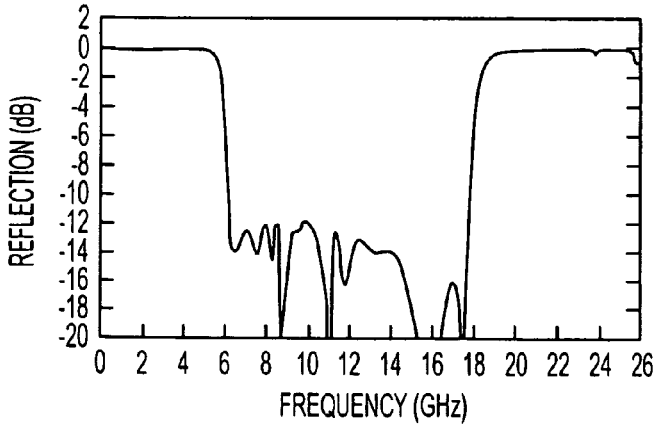

By employing reliable equivalent-circuit models, especially for the waveguide elements, and placing practical realizability constraints on these elements, a three-channel frequency multiplexer was successfully designed, demonstrating the practicability of the outlined new multiplexing approach. Pertinent response characteristics are shown in FIG. 18.

Alternative embodiments of the invention include the use of double-ridge waveguide in place of single-ridge waveguide, and the use of other inter-resonator coupling methods, such as the use of evanescent-mode guide sections other than ones with rectangular cross section or the use of predominantly capacitive coupling gaps. Materials used for filter dielectric cores may include a variety of ceramic materials, ones used with low-temperature co-fired ceramic (LTCC) processes, and any number of different low-loss moldable plastic dielectric materials. The use of air dielectric in combination with metal hollow-waveguide structures also constitutes a viable embodiment. As mentioned above, the filter port matching networks can be implemented with the help of 3D waveguide structures, rather than in a conventional microstrip or stripline format. When implemented in a strip-type configuration, the port matching networks may thus utilize other augmenting circuit elements than just the series-connected capacitive elements indicated in Experiment A, or the cascaded stepped-impedance transmission-line elements used in Experiment B.

Obviously many modifications and variations of the present invention are possible in the light of the above teachings. It is therefore to be understood that the scope of the invention should be determined by referring to the following appended claims.

What is claimed as new and desired to be protected by Letters Patent of the United States is:

1. A method of fabricating a ridge-waveguide filter with a signal input port and a signal output port, comprising:

forming a monolithic polymeric dielectric core configured for establishing a dielectric-filled cavity, said core including a plurality of spaced-apart depressions;

applying a layer of conducting metal to an outer surface of the core to form a metallized core with a conductive metal layer, said metal layer including port openings at opposite ends of the metallized core, wherein metallized depressions thereby formed are the ridges of the filter's ridge-waveguide sections; mounting the metallized core on a supporting carrier, and forming metallized channels in the core at the input and output ends of a ridge-waveguide filter to thereby effectively define a pair of end strip conductors positioned on dielectric substrates employed for port impedance-matching purposes.

2. A method of fabricating a frequency multiplexer, comprising a) forming a monolithic polymeric dielectric core configured for establishing a dielectric-filled cavity of a ridge-waveguide filter, said core including a plurality of spaced-apart depressions;

b) applying a layer of conducting metal to an outer surface of the core to form a metallized core with a conductive metal layer, said metal layer including port openings at opposite ends of the metallized core, wherein metallized depressions thereby formed are the ridges of the filter's ridge-waveguide sections; and c) mounting the metallized core on a supporting carrier to thereby form a channel filter;

d) repeating steps a-b until a desired number of filters are formed; and e) connecting said filters with an electrical-series-type connection among the ports of each of said filters that are not connected to strip impedance-matching conductors to form a frequency multiplexer having a waveguide manifold that includes a structural element selected from the group consisting of a ridge-waveguide segment, an evanescent-mode-waveguide segment, and a quasi-lumped reactive waveguide component, and combinations thereof.

3. A method as in claim 2, wherein the manifold is filled at least partially with moldable dielectric material.

4. A method as in claim 3, wherein the dielectric material is a composite of different dielectric materials with differing relative dielectric constants.

5. A method as in claim 4, wherein said filters have substantially rectangular cross sections and are vertically stacked.

6. A method as in claim 2, wherein external ports of channel filters not connected to the manifold are connected to impedance-matching circuits.

7. A method as in claim 2, further comprising an external heat sink, wherein the channel filters include external metallization thermally connected to the external heat sink to permit operation at elevated high-frequency signal levels.

8. A method as in claim 2, wherein the quasi-lumped reactive waveguide component is a constrictor.

9. A method as in claim 8, wherein said constrictor is selected from the group consisting of a waveguide iris and a post.

10. A method of fabricating a frequency multiplexer, comprising a) forming a monolithic polymeric dielectric core configured for establishing a dielectric-filled cavity of a ridge-waveguide filter, said core including a plurality of spaced-apart depressions;

b) applying a layer of conducting metal to an outer surface of the core to form a metallized core with a conductive metal layer, said metal layer including port openings at opposite ends of the metallized core, wherein metallized depressions thereby formed are the ridges of the filter's ridge-waveguide sections; and c) mounting the metallized core on a supporting carrier to thereby form a channel filter;

d) forming a metallized channel in the core at an end of the channel filter to thereby effectively define an end strip conductor positioned on a dielectric substrate employed for port impedance-matching purposes;

d) repeating steps a-b and then d until a desired number of filters are formed; and e) connecting said filters with an electrical-series-type connection among the ports of each of said filters that are not connected to strip impedance-matching conductors to form a frequency multiplexer having a waveguide manifold that includes a structural element selected from the group consisting of a ridge-waveguide segment, an evanescent-mode-waveguide segment, and a quasi-lumped reactive waveguide component, and combinations thereof.

* * * * *